United States Patent [19]

Brewer

[11] 3,951,346

[45] Apr. 20, 1976

[54] REVOLVABLE BLADE STRUCTURE

[75] Inventor: John C. Brewer, Salt Lake City, Utah

[73] Assignee: Garbalizer Corporation of America, Salt Lake City, Utah

[22] Filed: Mar. 24, 1975

[21] Appl. No.: 561,305

[52] U.S. Cl. ..... 241/32; 64/28 R

[51] Int. Cl.[2] ..... B02C 23/04

[58] Field of Search ..... 241/32; 64/28 R; 192/150

[56] References Cited

UNITED STATES PATENTS

| | | | |
|---|---|---|---|
| 1,781,891 | 11/1930 | Borton | 241/32 |
| 2,307,556 | 1/1943 | Wileman | 64/28 R |
| 3,708,127 | 1/1973 | Brewer | 241/32 |
| 3,762,655 | 10/1973 | Brewer | 241/32 |

*Primary Examiner*—Granville Y. Custer, Jr.
*Assistant Examiner*—Howard N. Goldberg

[57] ABSTRACT

Cutting or shearing structure wherein cutter or shearing blades are revolvably mounted yet pinned to hubs keyed to a central shaft. The shaft of hub structure is constructed for elimination of broken shear pin points. The shear pins themselves are disposed transversely relative to the shaft and are so positioned as to prevent lateral play of the blade ends as these pass through the spaces between operatively associated cutter blades.

10 Claims, 5 Drawing Figures

REVOLVABLE BLADE STRUCTURE

The present invention relates to blade structures and the like, used for cutting or shearing incoming materials, and, more particularly, to a new and improved revolvable blade structure incorporating shear pin means of novel positionment.

The inventor is the patentee of a number of other United States patents, including U.S. Pat. No. 3,893,635, over which this represents an improvement.

The present invention in general is related to the concept of a revolving shaft carrying a plurality of mutually interspaced cutting or shearing blades. Stationary cutter bar structure is oriented transversely with respect to the revolving shaft carrying the blades, such that the blades pass through the spaces between adjacent cutter bars. For many types of applications it is desired that the passage spaces between the adjacent cutter bars and through which the cutter blades are designed to travel enjoy a very close fit; this is to say, minimal tolerance or clearance should exist as between a representative blade and adjacent cutter bars, so that the cutting or shearing effect will be most effective. This feature is very important for hardened objects where steel or other metals are to be cut or sheared by the apparatus.

The inventor has heretofore designed blade structures which are rotatably mounted upon hubs that are keyed to the revolving shaft. The blade structure is so pinned that should any object become stuck between the blades and the cutter bars so as to tend to make the equipment fail, then solely the shear pins will fail so as to permit the shaft and the blade hubs to rotate within the individual blade or blades affected. Thus, the blades or other portions of the equipment will not be damaged and the shear pins need only be replaced, once the objects preventing a clean shear are removed from the cutting mechanism.

Central, therefore, to the basic design of the equipment is the provision whereby the shaft and its blade hubs are allowed to revolve and spin within one or more blades, where the pin or pins thereof simply shear due to overload as hereinbefore described. In order for the hubs to spin properly with a minimum of friction relative to the malfunctioning blade, there should be a hub clearance on both sides of and within the blade, relative to its hub, of the order of 7 to 15 thousands of an inch. Yet this very clearance may produce a slight askew movement of the plane of the blade relative to the axis of the shaft, during periods of keyed blade movement, so that the blade edges and more particularly the outer blade corners may chance to come in an impingement contact with the cutter bars. What is needed, therefore, is a means, simple to install and replace, whereby the blades can be exactly positioned in 90° relationship relative to the axis of the revolving shaft so that close tolerances may be held between the revolving blades and their cutter bars. It is noted that even though the shear pins are disposed transversely relative to the shaft, yet pin placement would not preclude a lateral shifting of the ends of the blades were the pins disposed on a vertical line which is essentially normal to the cutting plane defined by the intercooperation of the cutter bar edges with the shearing blade edges. What is needed, therefore, is a rotational displacement of the transverse shear pins, relative to the vertical axis of the blade structure, so that there cannot exist any wobble of the points of the blades as these enter proximity with the cutter bar edges.

Accordingly, in the present invention transverse shear pin means are used and are designed so that the same will shear proximate the juncture of the blades or blade halves and the base of the hub on which the blades ride. One or more shear pins is used, the axis of which is displaced away from that vertical plane which is normal to the essential cutting plane offered by the bars. This is to say, when the blade edges are in cutting or shearing position relative to the cutter bars, then the pins are off-vertical, so to speak, so that there will be no play in the blade tips relative to the closely spaced cutter bars operatively associated therewith.

Another feature of the invention is the provision of a hollow shaft so that tips of shear pins can fall into or simply be urged into the center of the shaft for automatic expulsion upon the insertion of new shear pins in the manner hereinafter set forth.

Accordingly, a principal object of the present invention is to provide new and improved cutter or shear structure.

An additional object is to provide for blade slippage in a hub, in the presence of overload conditions, wherein, prior to overload, the shear pins used also preclude an askew shifting of the blade in its revolvement travel.

An additional object is to provide for the transverse pinning of blade means to its hub and to provide for the automatic expulsion of shear pin points through the shaft proper at the axial bore thereof.

A further object of the invention is to provide cutting or shearing means with suitable shear pin structure uniquely oriented such that any intentional provision of tolerances and play of the blades relative to their hubs, to enable the shaft and hubs to revolve freely within the blade structures, will not be translated to the blade cutting edges and ends which must be held in strict alignment, during normal operating conditions, relative to the inter-cutter-bar blade-travel gaps.

The features of the present invention which are believed to be novel are set forth with particularity in the appended claims. The present invention, both as to its organization and manner of operation, together with further objects and advantages thereof, may best be understood by reference to the following description, taken in connection with the accompanying drawing in which:

Figure 3:
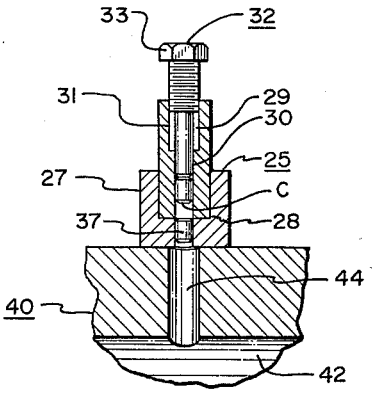
FIG. 3 is a fragmentary section view of the upper portion of the shaft, hub and blade, indicating shear pin replacement.
Figure 5:
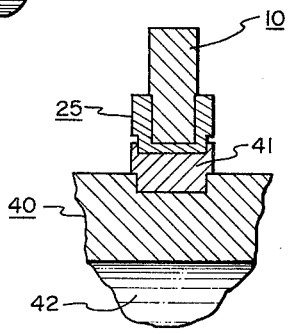
Figure 4:
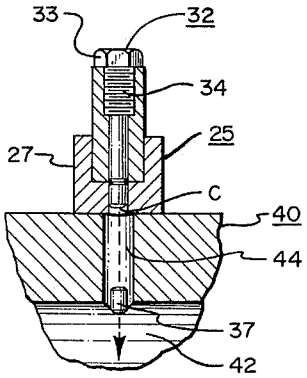

FIG. 4 is similar to FIG. 3 but illustrates that when a new shear pin is continued in its advance toward its intended position, the pin will thrust inwardly the broken-off shear point of the previous pin so that the same may fall into the actual bore of the shaft of the equipment, and FIG. 5 is a fragmentary enlarged view indicating the means by which the blade hubs are pinned to the revolvable shaft.

Figure 1:
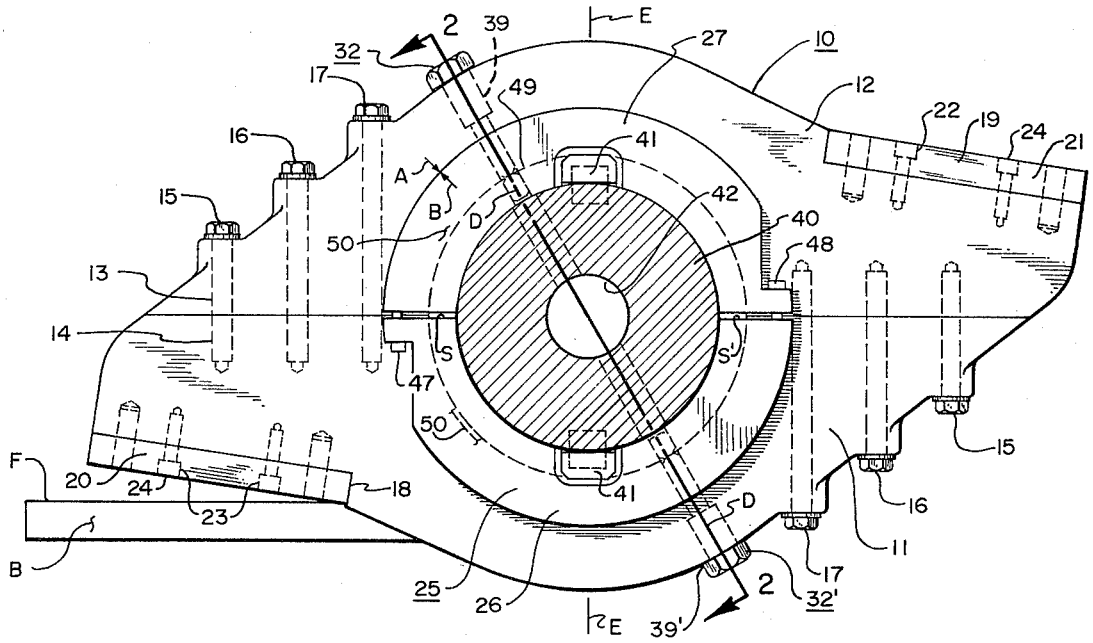
FIG. 1 is a front elevation of a blade construction as mounted upon revolving shaft and blade hubs, wherein transverse pin means are positioned in accordance with a preferred embodiment of the invention.

In FIG. 1, blade 10 comprises a pair of congruent, opposed blade halves 11 and 12 which are mutually provided with threaded apertures 13 and 14 of different lengths as indicated to receive blade halve securement bolts 15, 16, and 17, at each of two places.

Each of the blade halves 11 and 12 are recessed at 18 and 19 for receiving blade segments 20 and 21 as shown. The blade segments are provided with counterbores at 22 and 23, and other suitable apertures, as necessary, for receiving attachment machine screws 24 at a plurality of spaced points. The method of attachment may be purely conventional and also so designed such that the segments can be reversed, for lengthening shearing life. Hub 25 comprises a pair of hub segments 26 and 27 which in the aggregate form what resembles a segmented thickened washer having an annular, inner recess. This recess is shown at 28 relative to hub 25 in FIG. 3.

Each blade half 11 and 12 is provided with a counterbored aperture 29 provided with a bore 30 of reduced diameter and a threaded bore 31 of enlarged diameter. Shear pin 32 includes a hex head 33 and also an enlarged threaded portion 34 provided with reduced diameter pin shank 35. The latter is formed of two segments 36 and 37, with the latter comprising a pin extremity defined from the rest of the pin by an annular shear plane groove 38. The bore points 39 and 39' relative to the shear pins in FIG. 1 may be diametrically opposed as shown, if desired.

Figure 2:
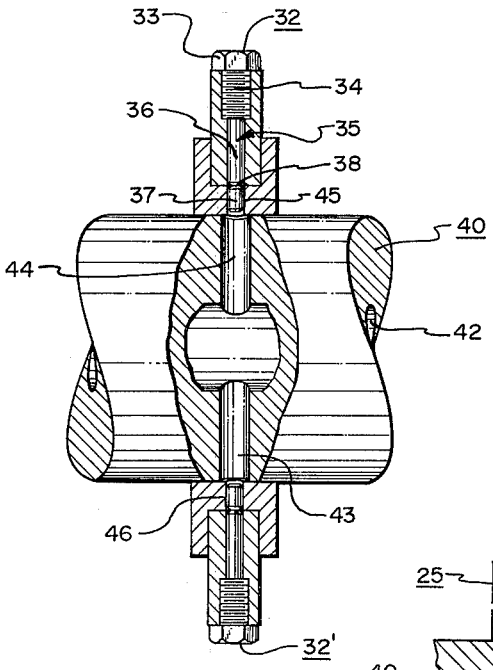
FIG. 2 is a transverse section taken along the line 2—2 in FIG. 1.

As indicated, it is seen that both of the shear pins 32 and 32', see FIG. 2, lie rectilinearly along the same axis. When desired, these may be made slightly askew relative to axial orientation; however, it is preferred that the shear pins be axially aligned for machining purposes, proper alignment, and a reversibility feature relative to the two blade halves.

Of importance is, of course, the hollow shaft 40 having axial bore 42. The hub segments 26 and 27 are keyed by conventional keys 41 at opposite sides of and to the shaft. The key arrangement is shown in enlarged fragmentary view in FIG. 5.

The shaft 40 has radial bores or apertures 43 and 44 which are transverse to the axial bore 42, communicating therewith and disposed in alignment with apertures 45 and 46 of hub segments 26 and 27. A favored design feature is that the length of the pin extremity as at 37 will be less than one-half the diameter of shaft bore 42. This is for purposes as hereinafter explained. The operation of the equipment as shown and described is as follows:

The shear blade construction as pinned to shaft 40, via hub segments 26 and 27, will revolve in accordance with the revolvement of the shaft; it is understood that the blade segments affixed to the shaft will proceed between parallel cutter bars B having cutting edges F which are used in conjunction with the blade construction for shearing purposes.

In the event of hang-up or overload during the operation of the blade, that is, where an item is present between the cutter bars and the subject blade where such item cannot be cut, then the applied torque to shaft 40 will cause the shear pins as at 32 and 32' in FIG. 2 to shear at the pin shear planes which are coincident with the annular grooves 38 of the pins. This provision is made so that damage to the remainder of the machine is precluded. Accordingly, the failure is restricted to the shear pins which can be easily replaced. Upon such failure, then the shear pins 32 are withdrawn by simply unscrewing the same by means of a wrench or other implement so as to withdraw the pins and install new pins in the manner shown in FIG. 3.

Once the shear pins 32 and 32' are withdrawn, then the blade or blades affected will be realigned with the combination of the shaft and its hub segments at 26 and 27. Thus, the equipment is realigned by the blade 10 and its mark at A being brought into alignment with mark B' on the hub. This will be sufficient to bring all of the holes relative to the shear pins in alignment so that new pins can be installed.

Installation of new shear pins is illustrated in FIG. 3, see shear pin 32 for example, so that as the shear pin is threaded down into aperture 29, the tip C thereof will push the broken pin segment 37 of the previously used pin down into the enlarged bore 44, from whence it will fall into bore 42 of hollow shaft 40. Note that when the diameter of the bore 42 is greater than twice the length of the pin segments at 37, then there obviously will be no interference as between broken pin segments proceeding into the bore area of the shaft from opposite directions.

What the present invention provides, therefore, is a unique means by which a revolving blade can be pinned by shear pins to the combination of a revolving shaft and its fixed hub, whether by keying a hub to the shaft or by other means. In the present instance a split hub construction as shown is deemed appropriate for shaft make-up and also convenience in disassembly of the equipment from the shaft either in toto or by virtue of the release of individual blades.

Finally, for securing the two hub segments together, bolts at 47 and 48 may be employed as in the applicant's U.S. Pat. No. 3,893,635 entitled SHREDDER STRUCTURE, incorporated fully herein by way of reference. The physical contour of the parts is likewise illustrated in FIG. 1 herein. Accordingly, it is noted that though the blade halves are tightened down hard against each other by the bolts 15, 16, and 17, the bore halves will be dimensioned such that a slight clearance of perhaps from 0.007 – 0.015 in. will exist between the outer annular surface 49 of the hub and the inner surface 50 of the blade. This is to allow the blade structure to revolve freely about the hub in the event of shear pin failure. Note however that bolts 47 and 48 are usable to tighten the hub segments securely down onto the shaft 40. A slight space S and S' is provided for this secure, tightening feature.

Most importantly, it is noted that axis D of the shear pins is separated from axis E which is disposed in quadrature or 90° relationship relative to the plane F. Thus, it is seen that the axis of the shear pins 32 and 32', whether rectilinear or not, are disposed away from axis E which is disposed 90° relative to the cutter bar lateral plane at F. Accordingly, the blade is precluded by the shear pins from movement laterally during times of shear even though there is provided substantial space between the blade sides and the inner surface of the hub of the order of 0.007 – 0.015 in. Accordingly, and most importantly, the shear pins not only provide the safety feature previously referenced but also preclude lateral pivotal movement of the blade within the slot provided by the hub structure. This is most important.

Therefore, what is provided is a new blade structure and shear pin structure therein which is easily replaceable, which provides for automatic expulsion of broken shear pin ends and, most importantly, which ensures that the blade structure will be stable while passing through adjacent cutter bars.

An additional important advantage is that the machine does not have to be disassembled for repair or for the simple replacement of shear pins, to place a blade structure again in operative condition on the shaft.

While particular embodiments of the present invention have been shown and described, it will be obvious to those skilled in the art that changes and modifications may be made without department from this invention in its broader aspects and, therefore, the aim in the appended claims is to cover all such changes and modifications as fall within the true spirit and scope of this invention.

I claim:

1. A revolving blade construction including, in combination, a revolvable shaft having an axial bore and provided with hub means for receiving a blade means; a blade means mounted upon said hub means for revolvement thereabout during times of overload, said blade means, hub means, and shaft having aligned, radially disposed apertures communicating with said axial bore; shear pin means removably disposed in said apertures of said blade means and hub means, said radially disposed aperture of said shaft being diametrically enlarged relative to said hub means aperture, whereby to permit an inner extremity of said shear pin means, when sheared due to overload, to freely pass from said hub means through said shaft to said bore thereof.

2. The construction of claim 1 wherein said bore of said shaft has a diameter in excess of twice the radial distance between said shaft and said blade means.

3. The construction of claim 1 wherein said shear pin means has a pin extension provided with a shear extremity defined by an annular, shear plane groove.

4. The construction of claim 1 wherein said hub means comprises plural hub segments mutually gapped apart and provided with interengaging securement means, and key means for keying said segments to said shaft.

5. The construction of claim 1 wherein said shear pin means includes a wrench receiving head, a threaded portion threadedly engaging said blade means' aperture, and a shear pin length provided with a medial, shear plane annular groove aligned with the juncture of said hub means and said blade means.

6. The construction of claim 1 wherein said shear pin means comprises a pair of oppositely disposed mutually facing shear pins.

7. The construction of claim 3 wherein said axial bore of said shaft has diameter dimension equivalent to more than twice the length of said shear extremity.

8. The construction of claim 6 wherein said blade means has at least one shearing edge, said shear pins being disposed on a common axis removed from that normal axis which is essentially disposed in ninety degree relationship relative to said shearing edge when said shearing edge is in the shearing region thereof.

9. A shearing construction including, in combination: a revolvable shaft having a hub; blade means disposed in constrained, axially relative revolvable relationship upon said hub for revolvement thereon during overload periods, said blade means having at least one shearing edge; an essentially horizontal cutter bar adjacent, parallel to, and cooperatively disposed with respect to said blade means; and shear pin means keying said blade means to said hub and aligned off-vertical, relative to said cutter bar, when said blade means is in shearing position, whereby to prevent blade means' extremity wobble during the shearing function.

10. The construction of claim 9 wherein said hub comprises a pair of hub segments secured together, keyed to said shaft, and medially peripherally recessed to receive said blade means, said shear pin means comprising a pair of shear pins respectively disposed in said hub segments, said blade means, hub, and shaft being provided with apertures accommodating said shear pins.

* * * * *